US005110617A

United States Patent [19]

Gundling et al.

[11] Patent Number: 5,110,617

[45] Date of Patent: May 5, 1992

[54] METHOD OF APPLYING MULTICOLOR FINISH TO ELONGATED CHANNEL MEMBER

[75] Inventors: Ray D. Gundling, Schaumburg; Joseph E. Kaminkow, Arlington Heights; Jay A. Hoffman, Jr., Forest Park, all of Ill.

[73] Assignee: Data East Pinball, Inc., Melrose Park, Ill.

[21] Appl. No.: 636,618

[22] Filed: Jan. 2, 1991

[51] Int. Cl.[5] ..... B05D 5/00; B05D 1/06

[52] U.S. Cl. ..... 427/14.1; 427/28; 427/181; 427/197; 427/203

[58] Field of Search ..... 427/14.1, 201, 181, 427/197, 199, 202, 205, 203, 265, 28; 273/118 R, 119 R, 120 R, 122 R, 124 R

[56] References Cited

U.S. PATENT DOCUMENTS 4,112,189 9/1978 Terwilliger ..... 427/264 X

*Primary Examiner*—Evan Lawrence

*Attorney, Agent, or Firm*—Gerstman & Ellis

[57] ABSTRACT

A method of applying a multicolor finish to an elongated channel member, particularly a ball channel for a pinball machine. A first fusible color coating is applied to a first portion of the channel member. A second fusible color coating is applied to a second portion of the channel member, while also applying the second color coating to a part of the first portion. The part of the first portion is adjacent the second portion, and the first and second color coatings are of different colors. Upon fusion of the color coatings the part of the first portion of the channel member assumes a third color that is a blend of the first and second colors, to provide a pleasing ball channel of at least three colors.

9 Claims, 1 Drawing Sheet

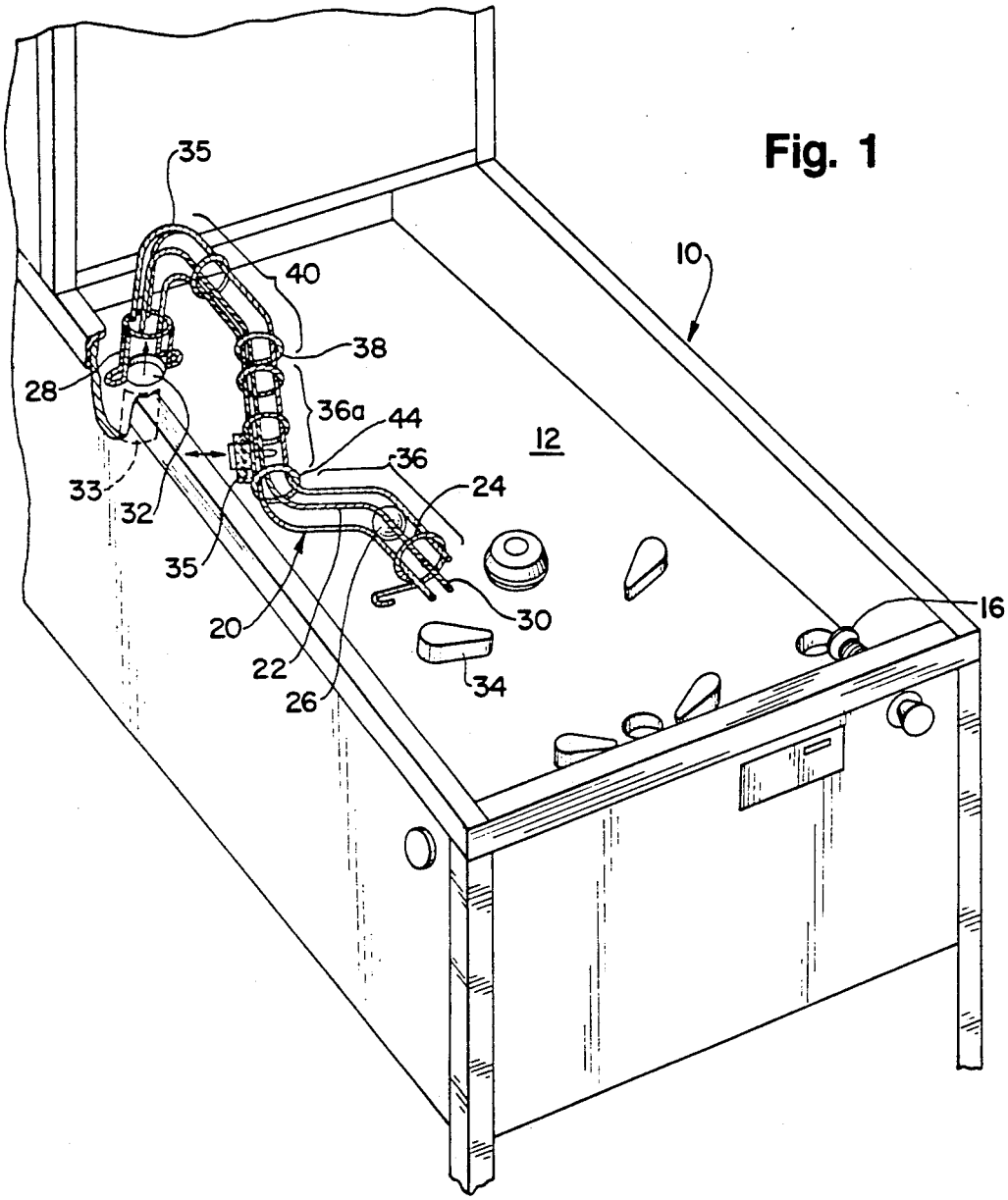
Fig. 1
Fig. 2
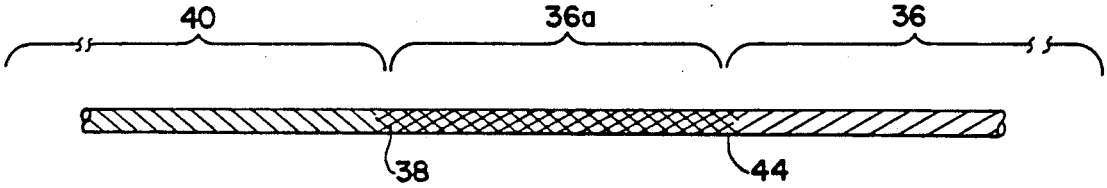

METHOD OF APPLYING MULTICOLOR FINISH TO ELONGATED CHANNEL MEMBER

BACKGROUND OF THE INVENTION

The invention pertains to a colored channel member which is particularly used as a multicolored ball channel or ramp in a pinball machine. In one use, pinball machines frequently have an upper level at the rear of the machine which can be reached by the pinball. Then, typically, a ramp is provided which, if the ball finds, the spot, conveys the ball to a specific location at the lower level of the pinball machine, typically to a scoring unit, after which the ball can be thrown back onto the playing field for further play.

Also a ball channel can be used on a single-level play field. If the ball gets to the right spot, it can be thrown up into the channel or ramp, and then conveyed by the channel to another part of the play field.

In the prior art, such ball channels or ramps have been made of bonded wires to form a wire tube which conveys the ball. The wires have been chrome plated.

A disadvantage of chrome plated wire ball channels or ramps in pinball machines is that, in a brightly lit pinball machine, the bright reflections of a chrome ball channel or ramps can distract the user. Also, the chrome ball ramps cannot visually stand out very well from the play field in such bright lighting, in part because of the confusing reflections they may emit. Additionally, weld burns and imperfections which are created as the ball channel or ramp is welded together out of wires and surrounding rings of wire are made to be visible with a chrome plated wire ball ramp.

It is of course greatly desirable in the pinball machine industry to provide new visual effects to increase the attractiveness of the pinball machines to the users. In accordance with this invention, a method is provided in which a ball channel or other elongated channel member may be provided with a colored and preferably a multi-colored finish in an easy, reliable manner, particularly a three color finish. Thus, by the method of this application, an improvement in the appearance and attractiveness of the pinball machine can be provided, as is essential for the marketing of economically successful pinball machines

SUMMARY OF THE INVENTION

In this invention, a method is provided of applying a multi-color finish to an elongated channel member.

By this method, one applies a first color coating to a first portion of the channel member. Then, one applies a second color coating to a second portion of the channel member, and also applies the second color coating to a part of the first portion, where such part is adjacent to the second portion of the channel member. The first and second color coatings are of different colors, preferably of colors which, when combined, provide another visually pleasing color. Accordingly, the part of the first portion which receives not only the first color coating but also the second color coating assumes a third color that is a blend of the first and second colors.

For example, the first color coating may be red, while the second color coating may be yellow, with each of the first and second color coatings extending from opposed ends of the channel member and overlapping each other in the part of the first portion described above. As a result of this, the part of the first portion having the overlapping color coatings can be of an orange color, distinctly different from the other two colors.

Furthermore, when the color coatings are applied as powdered coatings under electrostatic charge conditions in accordance with known technology, a gradation of color may be provided to the part of the first portion of the channel by gradually diminishing the amount of second color coating applied over the first color coating, as one moves from the second portion through the part of the first portion, toward the remainder of the first portion which does not have any of the second color coating. Alternatively, the gradual diminishment may be in the opposite direction. In such a circumstance, the channel member may be bright yellow, for example, at its first portion end, with a central portion exhibiting a gradation of color from yellow through shades of orange. The second portion of the channel member may then be deep red.

The above procedure is quite easy to accomplish, and exhibits a highly desirable color arrangement which can be very attractive, contributing significantly to the desirability of the pinball machine on the part of customers. Additionally, if desired, the first color may be blue and the second color may be red, with the part of the first portion having overlapping colors to provide a purple color, which may also be of changing, gradated shades from one end of the part to the other, from red through various shades of lavender and purple, to blue.

Additionally, where one color is yellow and the other color is blue, the central part area may show a gradation of shades of green Thus any desired color array may be used in accordance with this invention to provide a desirable, attractive three color (at least) array with a relatively easy manufacturing process.

Thermoplastic colored powders which may be applied to the channel member by electrostatic charge and then baked into place are well-known, being available, for example, from Tiger Drylac U.S.A. Inc. of Rancho Cucamonga, Calif. 91730. Such colored thermoplastic powders may be applied by an electrostatic sprayer to the channel member, with one end of the channel member being sprayed first, followed by spraying of the other end of the channel member with a powder of a different color, overlapping the first spray portion in a central area to form the part of the first portion. Then, the channel member, with the electrostatically adhering powder, may be baked or heating at about 420°–460° F. for about 10 to 20 minutes, followed by cooling. For example, the baking conditions may be about 450° F. for about 15 minutes in a conveyor oven, so that a continuous manufacturing process may be used in the manufacture of the tri-colored channel members of this invention.

Alternatively, the color coating may be applied n any other desired manner, such as by brush, spray, or dipping with any desired powder, paint, or other coating material.

The invention of this application also relates to a pinball machine which carries on its play field a ball channel which comprises metal wires, typically secured together by a series of metal wire retention rings. The ball channel comprising metal wires carrie a generally non-reflective color coating, to overcome the disadvantages of the prior art highly reflective chrome coating, the color being optionally of a single color, but preferably the different colors as described above. It is generally preferred for the elongated channel to be colored by means of a electrostatic adhering powder application process, for example as described above.

BRIEF DESCRIPTION OF DRAWINGS

In the drawings, FIG. 1 is a perspective view of a pinball machine, containing a ball channel made of metal wires and manufactured in accordance with the method of this invention; and FIG. 2 is a detailed, enlarged view of a single, longitudinal wire of the ball channel of FIG. 1, showing the part of the first portion having overlapping colors, and sections of the first and second portions adjacent thereto.

DESCRIPTION OF SPECIFIC EMBODIMENTS

In the drawings, a pinball machine 10 is disclosed, which carries a playing field 12, which may have access by a pinball launched by spring launcher 16. However, other designs of playing fields for pinball machines may be used equally in accordance with this invention, this one particular playing field being provided for illustrative purposes only.

The elongated ball channel member 20 of this invention is shown to be made of a series of longitudinal wires or rods 22 connected by wire rings 24 in such a manner as to support a rolling pinball 26 in its interior, and to convey the pinball from first end 28 of ball channel 20 to the other end 30. Ball channel 20 may be mounted so that its first end 28 communicates with an aperture 32 in the play field 14. Thus, as a ball rolling on the playing field 14 falls into aperture 32, it is thrust upwardly by conventional ball propulsion apparatus 33, past first turn 35 in channel member 20, to roll by gravity down the rest of the channel or ramp 20 to a desired spot in the lower field. Flipper 34 or the like may be provided to permit the user to bat the ball upwardly to the far end of the play field again for further pinball play.

It is to be understood that ball channels of the structure of ball channel 20 are known for use in pinball machines. Also, a typical pinball play field contains many other features such as targets and scoring devices, but the specific drawing is simplified for purposes of easier illustration of the invention.

If desired, a conventional ball retention member 35 may be provided at a point intermediate the ends of channel member 20, so that one or more balls may be captured and retained within the channel member 20 before rolling out of the downstream end 30 thereof. Then, by the program of the pinball game, retention member 35 may release one or more of the captured balls at any given time to continue the pinball game as described above.

In accordance with this invention, the longitudinal wires 22 that make up channel 20, and their respective support rings 24, are coated with colored powder coatings of the type previously described. A first portion 36, **36*a* of the ball ramp or channel 20 may be coated with a yellow powder coating, applied by a conventional electrostatic technique. The yellow powder coating extends to approximately point 38 on ball ramp 20**.

Then, a red powder coating is applied along portion 40 of ball ramp 20, which comprises the opposed end thereof. However, the red powder coating is also applied to overlap the yellow powder coating in intermediate area **36*a* previously referred to as a part of the first portion. The red powder coating extends to approximately point 44. The red coating is also of the electrostatic powder coating type and is conventionally applied. Between points 38 and 44, the concentration of the spray of red coating is preferably slowly reduced as the spray nozzle passes from about point 38 to point 44**, where the red powder spray terminates.

Then, the entire ball ramp assembly 20 is baked, for example at a temperature of 450° F. for about 15 minutes.

The resulting ball ramp 20 provides a pleasing display of three colors: deep red in section 40; a gradation of shades of orange from about point 38 to about point 44; and deep yellow in section 36, with both sections 36 and 40 extending to their respective ends of the ball ramp 20. The ball ramp of this invention is then secured in place in the pinball machine, to provide desired and attractive use therein.

The above has been offered for illustrative purposes only, and is not intended to limit the scope of the invention of this application, which is as defined in the claims below.

That which is claimed is:

1. A method of applying a multicolor finish to an elongated ball channel for a pinball machine, which comprises:

applying a first fusible color coating to a first portion of said ball channel; applying a second fusible color coating to a second portion of said ball channel, and also applying said second color coating to a part of said first portion, said part being adjacent to said second portion and said first and second color coatings being of different colors, fusing said color coatings whereby said part assumes a third color that is a blend of the first and second colors to cause the ball channel to display at least three colors.

2. The method of claim 1 in which said channel member is a ball channel comprising metal wires.

3. A method of applying a multicolor finish to an elongated ball channel for a pinball machine, which comprises:

applying a thermoplastic, electrostatically charged powder coating of a first color to a first portion of said ball channel;

applying a thermoplastic, electrostatically charged powder coating of a second color to a second portion of said ball channel and also to a part of said first portion adjacent said second portion; and heating said ball channel to fuse said powder coatings, whereby said part of the first portion assumes a third color that is a blend of the first and second colors to cause said ball channel to display at least three colors.

4. The method of claim 3 in which said ball channel is heated at 420°–460° F. for ten to twenty minutes, followed by cooling.

5. The method of claim 3 in which said ball channel comprises metal wires.

6. The method of claim 3 in which the thermoplastic powder coating of the second color is applied to the part of the first portion in a diminishing concentration along the part from the end of the part adjacent the second portion toward its opposed end, to provide a gradation of said third color.

7. A method of applying a multicolor finish to an elongated ball channel for a pinball machine, which comprises:

applying a thermoplastic, electrostatically charged powder coating of a first color to a first portion of said ball channel;

applying a thermoplastic, electrostatically charged powder coating of a second color to a second portion of said ball channel, and also to a part of said first portion adjacent said second portion, in which the thermoplastic powder coating of the second color is applied to the part of the first portion in a diminishing concentration along the part from the end of the part adjacent the second portion toward its opposed end; and heating said ball channel to fuse said powder coatings, whereby said part of the first portion assumes a third color of gradated shading that is a blend of the first and second colors, to cause said ball channel to display a variety of colors, said ball channel comprising metal wires.

8. The method of claim 7 in which said ball channel is heated at 420°–460° F. for 10 to 20 minutes, followed by cooling.

9. A method of applying in a multicolor finish to an elongated channel member, which comprises:

applying a first fusible color coating to a first portion of said channel member; applying a second fusible color coating to a second portion of said channel member, and also applying said second color coating to a part of said first portion, said color coatings being applied as powder coatings under electrostatic charge conditions, said part being adjacent to said second portion and said first and second color coatings being of different colors, fusing said color coatings, whereby said part assumes a third color that is a blend of the first and second colors.

* * * * *